US006615866B2

(12) United States Patent
Cook

(10) Patent No.: US 6,615,866 B2
(45) Date of Patent: Sep. 9, 2003

(54) HYDRAULIC POWER ASSEMBLY HAVING A REMOVABLE TOP

(75) Inventor: James Edward Cook, Rochester Hills, MI (US)

(73) Assignee: Morrell Incorporated, Auburn Hills, MI (US)

( * ) Notice: Subject to any disclaimer, the term of this patent is extended or adjusted under 35 U.S.C. 154(b) by 0 days.

(21) Appl. No.: 09/952,348

(22) Filed: Sep. 13, 2001

(65) Prior Publication Data

US 2003/0047218 A1 Mar. 13, 2003

(51) Int. Cl.[7] ..... F15B 11/08; F04B 53/00

(52) U.S. Cl. ..... 137/565.19; 137/565.33; 137/312; 137/544; 137/559; 417/234

(58) Field of Search ..... 137/565.17, 565.19, 137/565.33, 340, 559, 312, 544; 417/234, 423.3

(56) References Cited

U.S. PATENT DOCUMENTS

| | | | | | |
|---|---|---|---|---|---|
| 1,506,652 | A | * | 8/1924 | Maer | 137/565.19 |
| 2,455,271 | A | * | 11/1948 | Raymond | 137/565.19 |
| 2,455,747 | A | * | 12/1948 | Fischer et al. | 137/565.19 |
| 3,305,137 | A | * | 2/1967 | Gauthier et al. | 222/136 |
| 3,473,480 | A | * | 10/1969 | Kollman | 417/234 |
| 3,515,167 | A | * | 6/1970 | Svenson | 137/565.17 |
| 3,612,332 | A | * | 10/1971 | Clapp | 220/429 |
| 4,020,633 | A | | 5/1977 | Hehl | 60/445 |
| 4,208,171 | A | | 6/1980 | Jonsson | 417/15 |
| 4,327,554 | A | * | 5/1982 | Patil et al. | 220/901 |
| 4,993,457 | A | * | 2/1991 | Berfield | 137/899 |
| 5,553,794 | A | | 9/1996 | Oliver et al. | 241/36 |

* cited by examiner

*Primary Examiner*—A. Michael Chambers
(74) *Attorney, Agent, or Firm*—Howard & Howard

(57) ABSTRACT

A hydraulic power assembly (10) includes an electric motor (30) disposed on a removable top (26) outside a tank (12) defining a chamber (25). A first pump (32) depends from the removable top (26) and into the chamber (25) and includes a first inlet (34) and a first outlet (35) to deliver fluid to a fluid line (36) and a fluid distribution manifold (38) disposed on the removable top (26). A leakage line (52) extends from the pump (32) and through the removable top (26) and back through the removable top (26) and drains into the chamber (25) for determining if the pump (32) is operating efficiently. A heat exchanger (78) is adjacent the motor (30) for cooling the hydraulic fluid as it is returned into the chamber (25) thereby cooling the fluid in the chamber (25). The tank (12) also includes a liner (74) for reducing the noise of the pump (32).

46 Claims, 4 Drawing Sheets

86
87
76
78
10
30
59 55
38
84,85
56
28
72,73
64
26
60
79
24
58
80
52
35
65
12
62
82
20
54
34
83
48
74
46
81
14
50
18
36
37
22

41
70
10
30
16
26
64
43
64
40
20
38
40
58
42
88
89
66
64
18
14
64
56
44

HYDRAULIC POWER ASSEMBLY HAVING A REMOVABLE TOP

BACKGROUND OF THE INVENTION

1. Field of the Invention

The subject invention relates to a hydraulic power unit for supplying hydraulic fluid to various hydraulic devices that control hydraulic fluid pressure, velocity, and direction.

2. Description of the Prior Art

Various assemblies are used to deliver hydraulic fluid from a tank to hydraulic devices. Most assemblies include a tank having a bottom and a peripheral side wall extending upwardly from the bottom to a top opening for defining a chamber for containing fluid. The assembly further includes a motor, a first pump having a first inlet and a first outlet, a drive interconnecting the motor and the first pump, a fluid distribution manifold, and a fluid line interconnecting the pump first outlet and the manifold for conveying fluid from the first outlet to the manifold.

However, these assemblies are very large and occupy a large amount of space, which may be limited in factories and work spaces. Additionally, these assemblies require the entire system to be shut down for minor repairs and do not provide for easily removal of the components such as the pump. These assemblies are not interchangeable with different assemblies and are designed to interact only with their specific assembly and can not be expanded to fit differently sized tanks.

There are removable assemblies which allow for easy access and repair. One such assembly is shown in U.S. Pat. No. 5,553,794 to Oliver et al. The '794 Patent discloses a pump system being disposed within a tank. The pump system comprises a pump housing, a removable top, and a pump motor having a shaft that extends through an opening. The pump housing is attached to the removable top and houses a pump that is connected to the shaft. When the pump motor is operated, the shaft rotates and operates the pump. The pump system also includes a liquid level detector having three positions. When the highest position is reached, the pump is operated to lower the level inside the tank.

However, one disadvantage is there is no way to ensure that the pump is operating efficiently. The entire assembly must be shut down and taken apart in order for the pump to be tested to determine if the pump is operating efficiently.

SUMMARY OF THE INVENTION AND ADVANTAGES

The subject invention provides a hydraulic power assembly comprising a tank having a bottom and a peripheral side wall extending upwardly from the bottom to a top opening for defining a chamber for containing hydraulic fluid and a removable top disposed over the top opening to close the chamber. A motor is disposed on the removable top outside the chamber and a drive is in sealing engagement with the removable top to connect the motor and a first pump having a first inlet and a first outlet depending from the removable top and into the chamber. A fluid distribution manifold is also disposed on the removable top out side the chamber and a fluid line interconnects the pump outlet and the manifold for conveying fluid from the outlet to the manifold.

Accordingly, the invention provides a compact and modular hydraulic unit wherein the components are supported by a removable top and wherein the removable top may be multiplied to increase the capacity of a hydraulic unit by merely adding additional tops with the components supported thereon. Additionally, the removable top being removable from the tank allows easy access to repair and replace the pumps without having to drain the hydraulic fluid from the tank.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
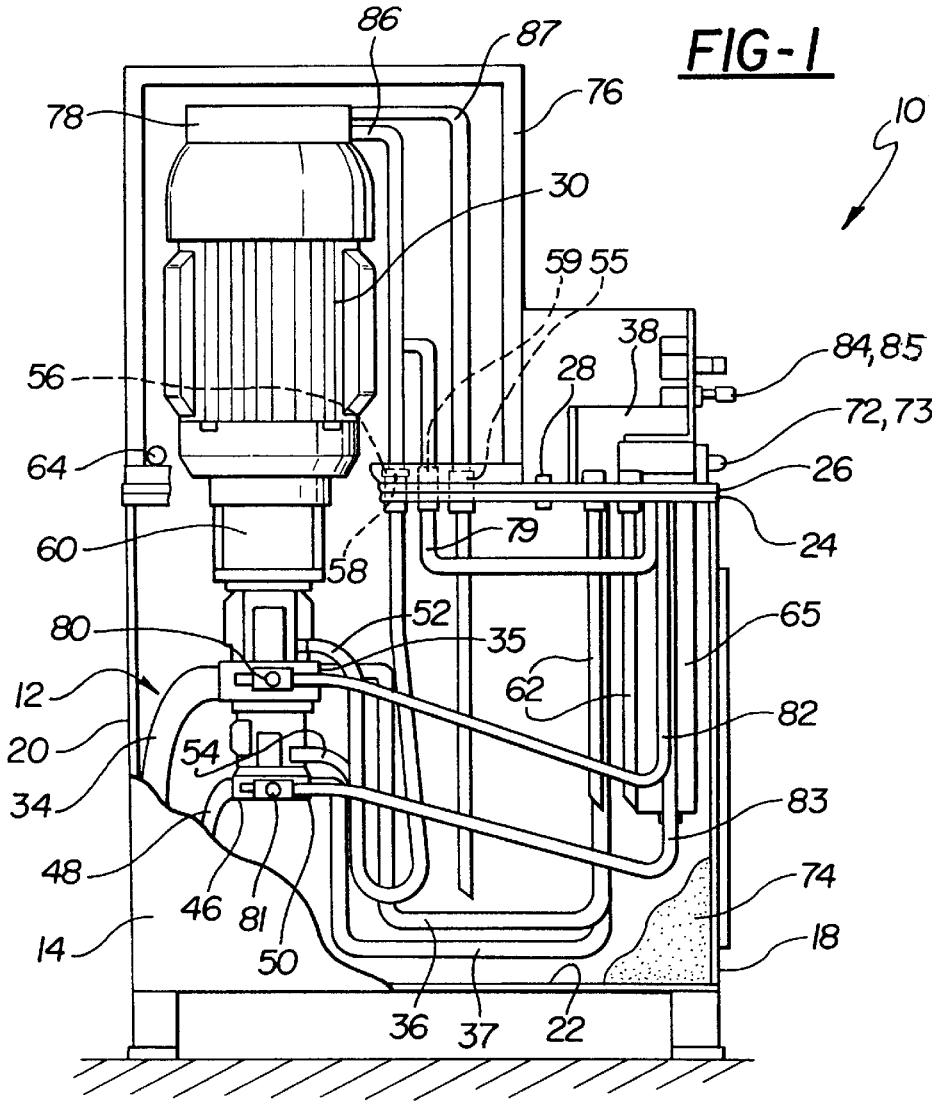
FIG. 1 is a left side view partially broken away of a hydraulic power assembly incorporating the subject invention.

Referring to the Figures, wherein like numerals indicate like or corresponding parts throughout the several views, a hydraulic power assembly constructed in accordance with the subject invention is generally shown at 10.

The assembly 10 includes a tank, generally indicated at 12, having a bottom 22 and a peripheral side wall 13, having four sides including left side 14, right side 16, front 18 and back 20, i.e., four sides, extending upwardly from the bottom 22 to a top opening. It is to be appreciated that the subject invention could be designed to fit a wide range of tank shapes, such as circular, oval, or rectangular. The tank 12 includes a flange, extending about the side walls 14, 16, 18, 20 for defining a rectangular in shape chamber 25 for containing the hydraulic fluid.

The tank 12 further includes a liner 74 which covers the interior side walls of the chamber 25. The liner 74 may be formed of a foam such polyurethane. The liner 74 insulates and reduces noise emitted from the chamber 25. In the preferred embodiment, the liner 72 is a polyether resin and is more preferably an amine-terminated polyether resin having isocyanate groups. The liner 72 is commercially available under the name Quantum Shield from Aristo-Cote, Inc. The liner 72 reduces the noise of the operating pump in the tank 12 by 3–4 decibels.

Figure 2:
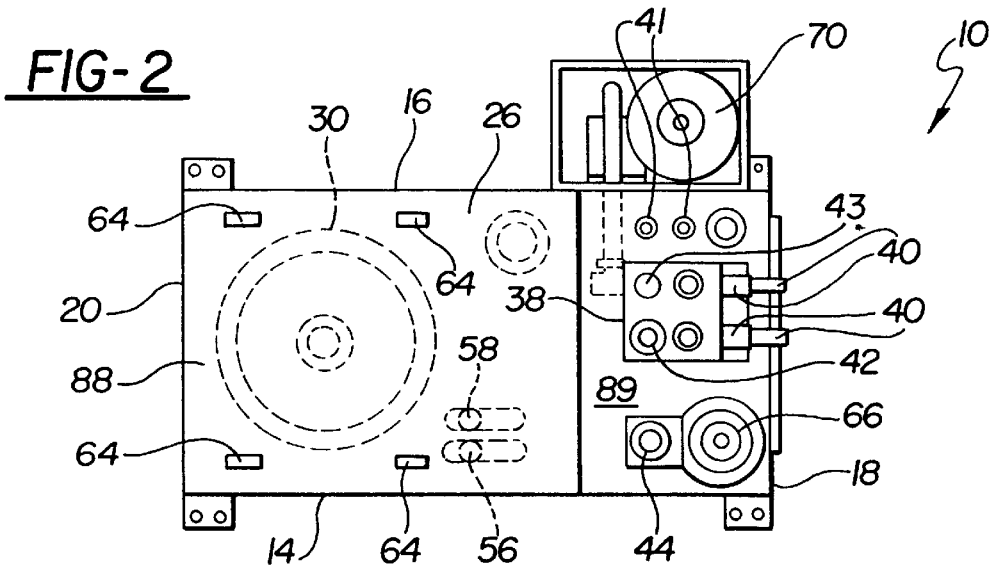
FIG. 2 is a top view of the hydraulic power assembly of the subject invention.
Figure 4:
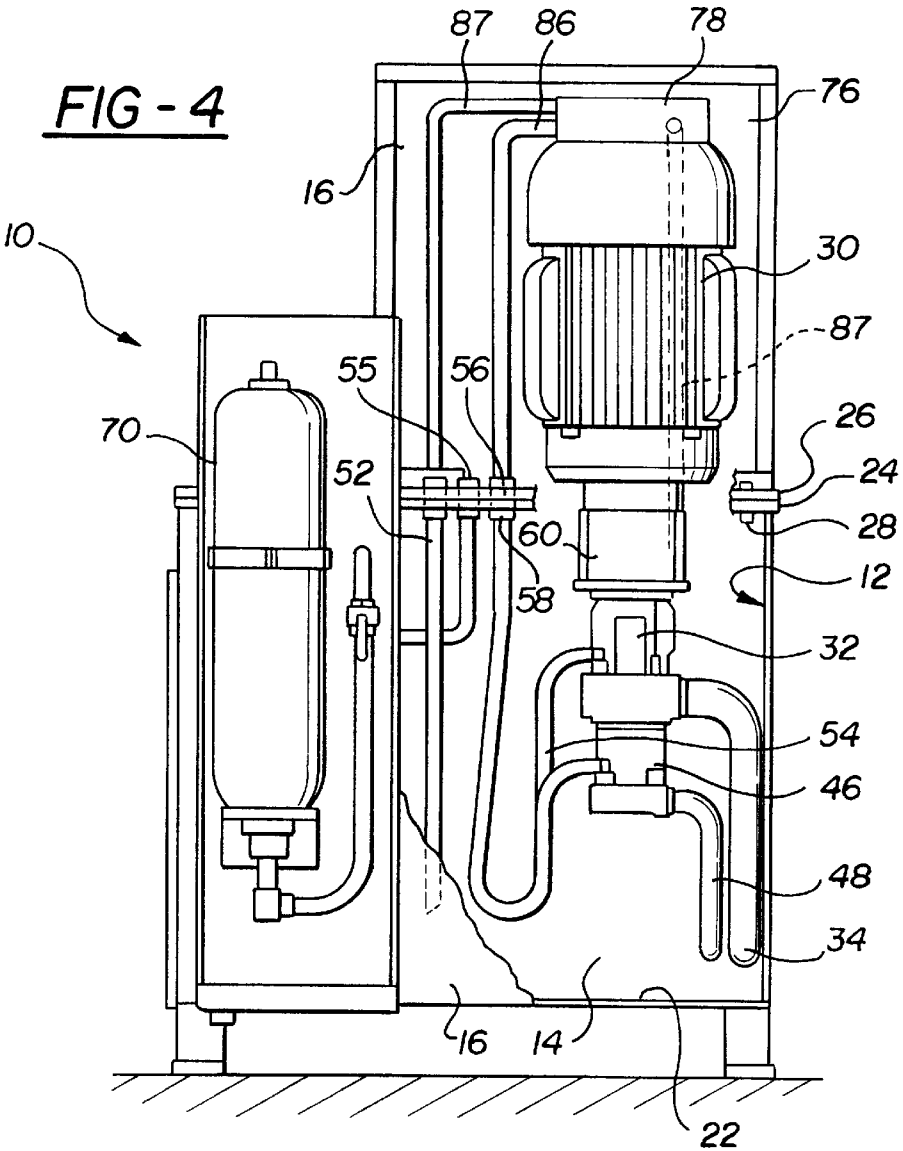
FIG. 4 is a right side view taken from the left of FIG. 3.
Figure 6:
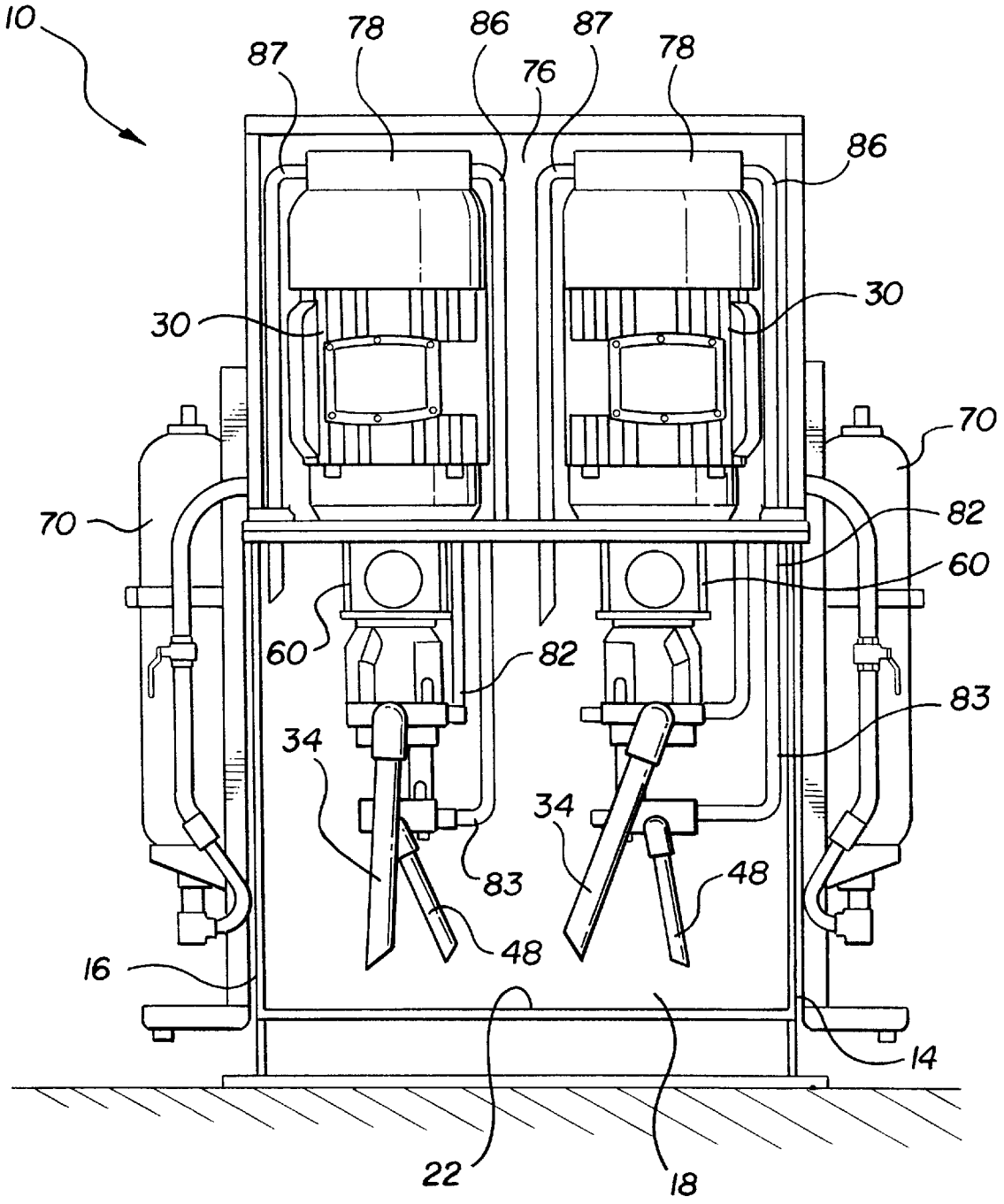
FIG. 6 is back view of the subject invention having multiple hydraulic power assemblies over a large capacity tank.

A removable top 26 is disposed over the top opening 24 to close the chamber 25 defined by the tank 12. The removable top 26 includes a first half 88 and a second half 89 such that the first half 88 is movable independent of the second half 89, as shown in FIG. 2. A plurality of fasteners 28 interconnect the removable top 26 and the flange defining the removable top opening 24. Preferably, the fasteners 28 secure both the first half 88 and the second half 89 to the tank 12 and are removable for allowing removal of the entire removable top 26. However, the second half 89 may be permanently attached to the tank 12 with only the first half 88 being removable. Multiple removable tops 26 may be positioned adjacent one another to fit larger capacity tanks 12, as shown in FIG. 6, as such is the feature of modularity. Having multiple removable tops 26 reduces the floor space that is required for the hydraulic power unit. For example, the floor space required for a 150 gallon tank is reduced by 47% and the floor space required for a 300 gallon tank is reduced 60% using the removable tops of the subject invention.

An electric motor 30 is disposed on the removable top 26 outside the chamber 25 defined by the tank 12. A first pump 32 depends from the removable top 26 and into the chamber 25 and includes a first inlet 34 and a first outlet 35. A drive 60 interconnects the motor 30 and drives the first pump 32. The drive 60 is in sealing engagement with the removable top 26. Preferably, the first half 88 of the removable top 26 supports the motor 30, the first pump 32, and the drive 60. The first outlet 35 delivers fluid into a fluid line 36 which is connected to a fluid distribution manifold 38. The fluid distribution manifold 38 is disposed on the removable top 26 out side of the chamber 25 and includes a plurality of valves 40 for distributing fluid through outlet ports 42, 43 to hydraulic devices and a return port 44 for receiving return fluid. Preferably, the manifold 38 and the plurality of valves 40 are supported by the second half 89 of the removable top 26. When multiple removable tops 26 are used, each top has additional pumps which provide additional fluid flow for the hydraulic devices.

In the preferred embodiment, a second pump 46 depends from the first pump 32 and includes a second inlet 48 and a second outlet 50. Accordingly, another fluid line 37 interconnects the second outlet 50 to the fluid distribution manifold 38. The fluid lines 36, 37 of the respective pumps 32, 46 and the manifold 38 are used for conveying fluid from the outlets to the manifold 38. The second pump 46 may be a lower capacity pump than the first pump 32 and, therefore, delivers a less amount of fluid than the first pump 32. The drive 60 drives the second pump 46 in series with the first pump 32. Each pump outlet 32, 46 is connected to a relief valve 72, 73, respectively, within the manifold 38 for over pressure protection.

Each pump 32, 46 is in fluid communication with a first leakage line 52 and a second leakage 54, respectively, for receiving leakage between the respective inlets 34, 48 and the outlets 35, 50. The pumps 32, 46 may be positive displacement pumps having a pressure differential between the inlets 34, 48 and outlets 35, 50. Since all pumps are constructed having some inefficiencies, the pumps 32, 46 will have leakage present in the leakage lines 52, 54. The leakage lines 52, 54 extend from the respective pumps 32, 46 and through the removable top 26 via a heat exchanger. and back through the removable top 26 for drainage into the chamber 25. Each of the leakage lines 52, 54 are used to determine if the pumps 32, 46 are operating efficiently. As the pumps 32, 46 become less efficient, the leakage lines 52, 54 will flow more hydraulic fluid. The leakage is measured to determine pump efficiency, and therefore, the leakage lines 52, 54 include ports 56, 58 for viewing and measuring the fluid flow in the leakage lines 52, 54. Testing flow gages are used to determine excessive leakage in the leakage lines 52, 54. If flow in the leakage lines 52, 54 is determined to be excessive, the first half 88 of the removable top 26 can be removed from the tank 12 and the pumps 32, 46 can be replaced or repaired. The tank 12 does not have to be drained to access the pumps 32, 46 or the drive 60.

The hydraulic power assembly 10 further includes at least one return drain port 41 and at least one drain line 62 which returns the fluid from the hydraulic system devices to the chamber 25. The assembly 10 also includes a filter 66 in fluid communication with the hydraulic fluid for filtering out impurities. The filter 66 is positioned within the return port 44 for filtering the hydraulic fluid as it is returned to the tank 12. An exit port 65 returns the filter hydraulic fluid to the tank 12. Alternately, a third pump may extend from the removable top 26 and be driven by the electric motor 30 and drive 60 for circulating the hydraulic fluid only though the filter 66 and back into the chamber 25.

A heat exchanger 78 may be disposed in fluid communication with the pumps 32, 46 for cooling the fluid. The heat exchanger 78 is positioned adjacent the motor 30, such that the air taken in by the fan of the motor 30 is used by the heat exchanger 78. In order to accomplish this, the heat exchanger 78 is positioned above the motor 30. The heat exchanger 78 is an air to oil heat exchanger in that as the motor 30 draws air in, the air is used to cool the hydraulic fluid. An inlet cooling line 86 delivers the fluid to be cooled from ports 56, 58 to the heat exchanger 78. An outlet cooling line 87 delivers the cooled fluid back via port 55 into the tank 12. The pumps 32, 46 include a first pressure compensation valve 80 and a second compensation valve 81, respectively. The pressure compensation valves 80, 81, shown in FIG. 1, are connected to a remote pressure control valve 84, 85, shown in FIG. 2, by relief lines 82, 83. The remote pressure control valve 84, 85 manipulate the pressure of the pumps 32, 46. The return oil from the remote pressure control valve 84, 85, located in the manifold 38, is connected to the inlet cooling line 86 via a connector line 79 and then through the heat exchanger 72 to provide additional cooling of the hydraulic fluid. The hydraulic fluid in the tank 12 acts as an insulator and increases the temperature of the hydraulic fluid. The cooled fluid is introduced into the tank in sufficient amounts to lower the internal temperature and lower the temperature of the hydraulic fluid. The inlet cooling line 86, shown in FIG. 5, receives fluid from the pumps 32, 46 via the leakage lines 52, 54 and combines the return oil fluid from the remote pressure control valve 84, 85 via connector line 79. Once combined, the cooling line 86 feeds into the heat exchanger 78 and returns the fluid to the tank 12 in the outlet cooling line 87 and port 55.

In a similar fashion of the tank 12 with the liner 74, the heat exchanger 78 and the motor 30 are surrounded by a foam-lined shroud 76. The shroud 76 has an open top or vents for allowing ventilation to the motor 30 and the heat exchanger 78. The shroud 76 reduces the noise of the motor 30 by 3–4 decibels.

The assembly 10 further includes a plurality of lift devices 64 disposed about the removable top 26 for lifting the removable top 26 along with the motor 30, the pump 32, 46, the manifold 38 and the drive 60 from the side wall 14, 16, 18 and 20. Preferably, the lift devices 64 are eyelets screwed or welded to the removable top 26. However, the lift devices 64 may be any device as is known in the art for hoisting and may be attached in any suitable manner. The lift devices 64 may be positioned around both the first half 88 and the second half 89, even if the first half 88 is the only half that is removed. The removable top allows the interchangeability of the tank 12 and the top 26 or either top half 88, 89 as desired. Another aspect of the subject invention is that the first half 88 can be removed without disconnecting any return lines 62 from the manifold 38 on the second half 89.

Figure 3:
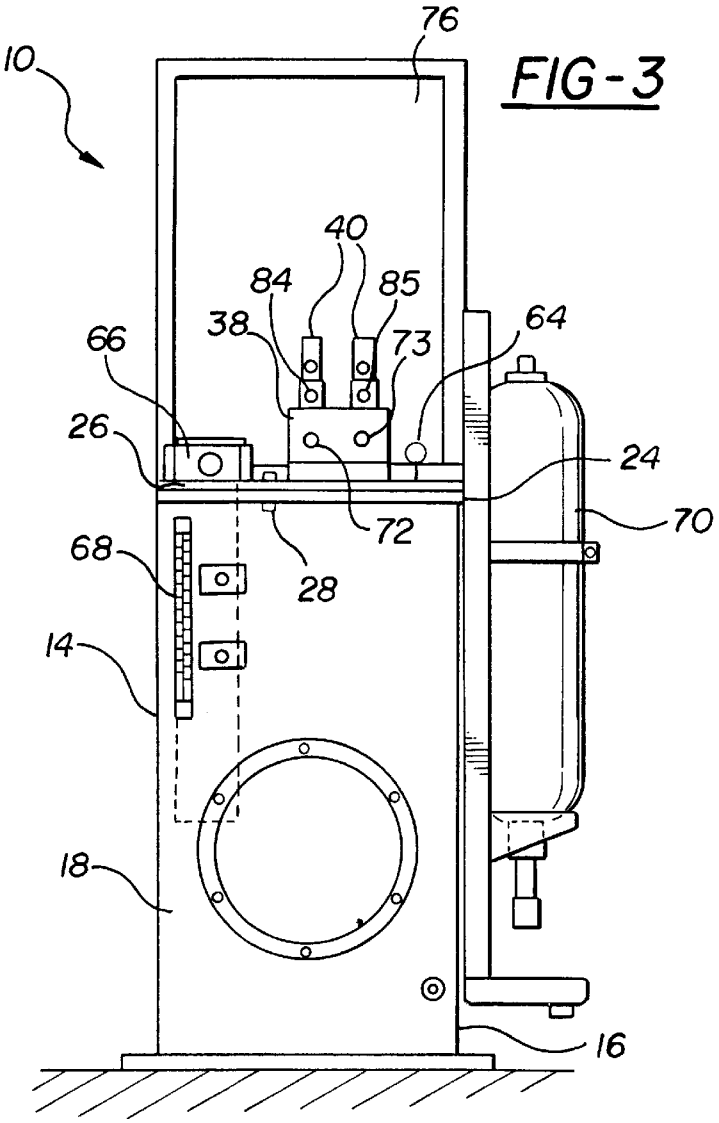
FIG. 3 is front view taken from the right of FIG. 2.
Figure 5:
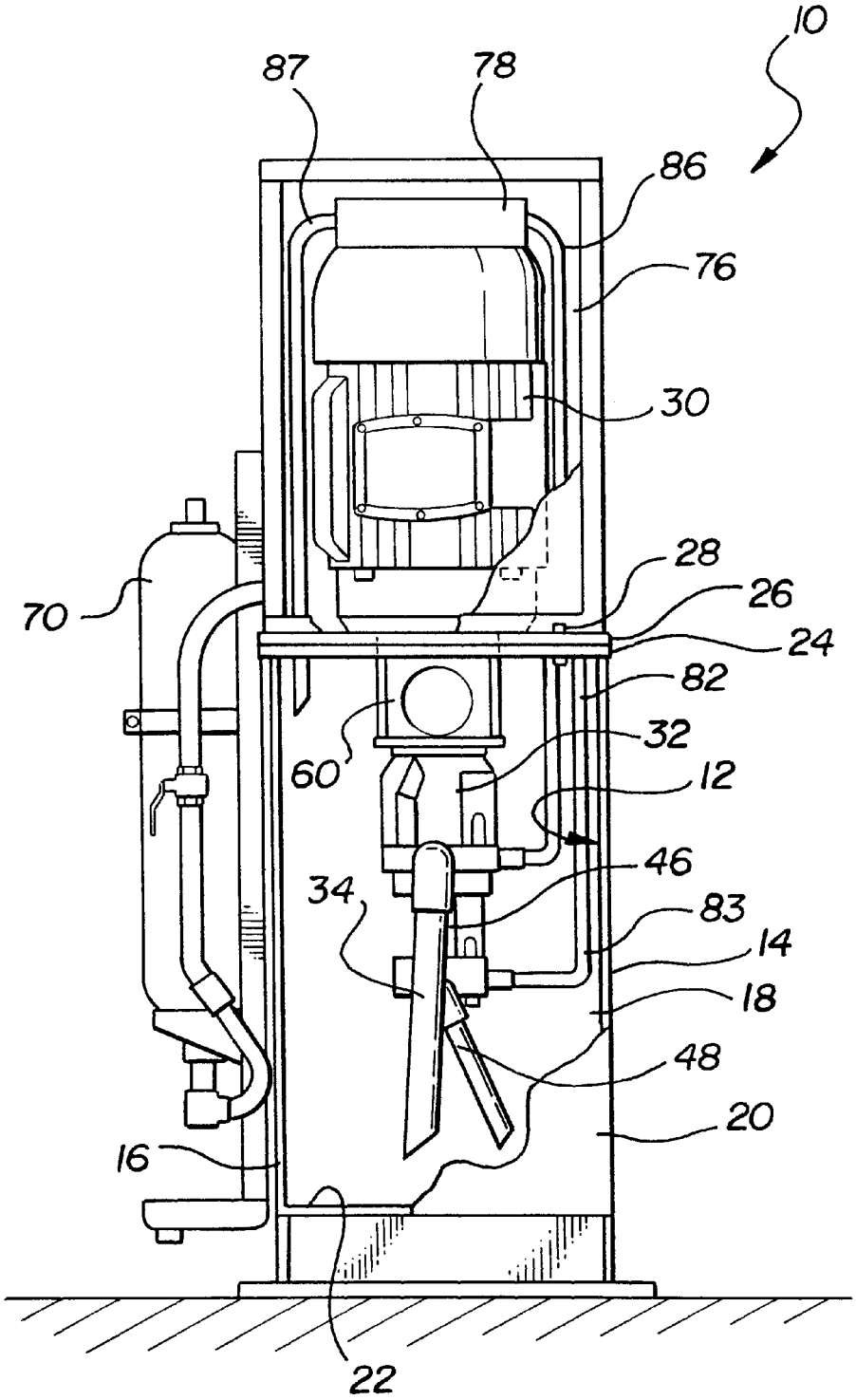
FIG. 5 is a back view taken from the right of FIG. 4.

In addition, a tank sight gage 68, shown in FIG. 3, is disposed on the side wall 13 and is in fluid communication with the chamber 25 for indicating the level of fluid in the tank 12. An accumulator 70, shown in FIG. 5, is supported on the side of the tank 12 for energy storage and supplementing the outputs of pumps 32, 46. However, the accumulator 70 is optional for carrying out the subject invention. FIG. 6 shows the subject invention having multiple assemblies having two accumulators 70. However, certain parts may be removed when using multiple assemblies such as the second accumulator and only use one accumulator even though multiple assemblies are used.

Obviously, many modifications and variations of the present invention are possible in light of the above teachings. The invention may be practiced otherwise than as specifically described within the scope of the appended claims. In addition, the reference numerals in the claims are merely for convenience and are not to be read in any way as limiting.

GLOSSARY OF REFERENCE NUMERALS

| | |
|---|---|
| assembly | 10 |
| tank | 12 |
| peripheral side wall | 13 |
| left side | 14 |
| right side | 16 |
| front | 18 |
| back | 20 |
| bottom | 22 |
| top opening | 24 |
| chamber | 25 |
| removable top | 26 |
| fasteners | 28 |
| motor | 30 |
| first pump | 32 |
| first inlet | 34 |
| first outlet | 35 |
| fluid line | 36 |
| fluid distribution manifold | 38 |
| plurality of valves | 40 |
| drain port | 41 |
| outlet port | 42, 43 |
| return port | 44 |
| second pump | 46 |
| second inlet | 48 |
| second outlet | 50 |
| leakage line | 52, 54 |
| leakage return port | 55 |
| pump leakage ports | 56, 58 |
| drive | 60 |
| return line | 62 |
| lift devices | 64 |
| exit port | 65 |
| return filter | 66 |
| tank sight gages | 68 |
| accumulator | 70 |
| pressure relief valve | 72, 73 |
| liner | 74 |
| shroud | 76 |
| heat exchanger | 78 |
| compensation valves | 80, 81 |
| connector line | 79 |
| relief lines | 82, 83 |
| remote pressure controls | 84, 85 |
| inlet cooling line | 86 |
| outlet cooling line | 87 |
| first half | 88 |
| second half | 89 |

What is claimed is:

1. A hydraulic power assembly for delivering hydraulic fluid to a plurality of hydraulic device, said hydraulic power assembly comprising;

a tank (12) having a bottom (22) and a peripheral side wall (13) extending upwardly from said bottom (22) to a top opening (24) for defining a chamber (25) for containing fluid, a removable top (26) disposed over said top opening (24) to close said chamber (25), a motor (30) disposed on said removable top (26) and extending outside said chamber (25), a first pump (32) depending from said removable top (26) and into said chamber (25) and including a first inlet (34) and a first outlet (35), a drive (60) interconnecting said motor (30) and said first pump (32) and in sealing engagement with said removable top (26), a fluid distribution manifold (38) disposed on said removable top (26) and outside said chamber (25), a fluid line (36) interconnecting said first pump first outlet (35) and said manifold (38) for conveying fluid from said first outlet (35) to said manifold (38), and a leakage line (52) in fluid communication with said first pump (32) for receiving leakage between said first inlet (34) and said first outlet (35) and extending from said tank (12) for measuring the leakage of said first pump (32).

2. An assembly as set forth in claim 1 wherein said leakage line (52) is further defined as extending from said tank (12) through said removable top (26).

3. An assembly as set forth in claim 2 wherein said first leakage line (52) includes a pump leakage port (56) for viewing fluid flow in said first leakage line (52) and measuring the amount of leakage for said first pump (32).

4. An assembly as set forth in claim 2 further including a heat exchanger (78) adjacent said motor (30) receiving the fluid within said tank (12), cooling the fluid and returning the cooled fluid to said tank (12).

5. An assembly as set forth in claim 4 further including a first relief line (82) connected to said first pump (32) for reducing the pressure of said first pump (32).

6. An assembly as set forth in claim 5 further including a remote pressure control (84) connected to said first relief line (82) outside of said tank (12) for controlling the pressure of said first pump (32).

7. An assembly as set forth in claim 6 wherein said first pump (32) further includes a pressure compensation valve (80) being connected to said first relief line (82) for allowing the pressure of said first pump (32) to be changed.

8. An assembly as set forth in claim 6 further including an inlet cooling line (86) extending from said tank (12) and into said heat exchanger (78) for cooling the fluid.

9. An assembly as set forth in claim 8 wherein said inlet cooling line (86) is connected to said first leakage line (52) and said heat exchanger (78) for carrying the fluid into said heat exchanger (78).

10. An assembly as set forth in claim 8 wherein said inlet cooling line (86) is connected to said first relief line (82) and said heat exchanger (78) for carrying the fluid into said heat exchanger (78).

11. An assembly as set forth in claim 8 wherein said inlet cooling line (86) is connected to said first leakage line (52), said first relief line (82), and said heat exchanger (78) for combining the fluid in said first leakage line (52) and said first relief line (82).

12. An assembly as set forth in claim 8 further including an outlet cooling line (87) extending from said heat exchanger (78) and into said tank (12) for returning the cooled fluid into said tank (12).

13. An assembly as set forth in claim 4 including a second pump (46) driven in series with said first pump (32) by said drive (60).

14. An assembly as set forth in claim 13 including a leakage line (54) in fluid communication with said second pump (46) for receiving leakage between a second inlet (48) and a second outlet (50), said second leakage line (54) extending through said removable top (26) for measuring the leakage of said second pump (46).

15. An assembly as set forth in claim 14 further including a second relief line (83) connected to said second pump (46) for reducing the fluid flow through said second pump (46).

16. An assembly as set forth in claim 15 further including a remote pressure control (84) connected to said second relief line (83) outside of said tank (12) for controlling the pressure of said second pump (46).

17. An assembly as set forth in claim 16 wherein said second pump (46) further includes a second pressure compensation valve (81) being connected to said second relief line (83) for allowing the pressure of said first second pump (46) to be changed.

18. An assembly as set forth in claim 17 further including an inlet cooling line (86) extending from said tank (12) and into said heat exchanger (78) for cooling the fluid.

19. An assembly as set forth in claim 18 wherein said inlet cooling line (86) is connected to said second leakage line (54) and said heat exchanger (78) for carrying the fluid into said heat exchanger (78).

20. An assembly as set forth in claim 18 wherein said inlet cooling line (86) is connected to said second relief line (83) and said heat exchanger (78) for carrying the fluid into said heat exchanger (78).

21. An assembly as set forth in claim 18 wherein said inlet cooling line (86) is connected to said second leakage line (54), said second relief line (83), and said heat exchanger (78) for combining the fluid in said leakage line (52) and said relief line (82).

22. An assembly as set forth in claim 18 further including an outlet cooling line (87) extending from said heat exchanger (78) and into said tank (12) for returning the cooled fluid into said tank (12).

23. An assembly as set forth in claim 2 wherein said manifold (38) includes a plurality of valves (40) for directing fluid to various devices.

24. An assembly as set forth in claim 23 wherein said manifold (38) includes a return port (44) for receiving return fluid and a return line (62) for returning the return fluid to said chamber (25).

25. An assembly as set forth in claim 13 wherein said second pump (46) has a different pumping capacity than said first pump (32).

26. An assembly as set forth in claim 1 further including fasteners (28) interconnecting said removable top (26) and said side wall (13) for securing said removable top (26) to said side wall (13).

27. An assembly as set forth in claim 1 wherein said removable top includes a first half (88) and a second half (89), said first half (88) supporting said motor (30) and said second half (89) supporting said fluid manifold (38) such that said first half (88) is movable independent of second half (89).

28. An assembly as set forth in claim 1 including lift devices (64) on said removable top (26) for lifting said removable top (26) along with said motor (30), said first pump (32), and said drive (60) from said tank (12).

29. An assembly as set forth in claim 1 wherein said peripheral side wall (13) includes four sides (14), (16), (18) and (20) defining a rectangular shaped tank.

30. An assembly as set forth in claim 1 including a filter (66) in fluid communication with said manifold (38) for filtering the fluid.

31. An assembly as set forth in claim 1 including tank sight gages (68) disposed on said side wall (13) and in fluid communication with said chamber (25) for indicating the level of fluid in said tank (12).

32. An assembly as set forth in claim 1 including a pressure relief valve (72) disposed in said removable top (26) for relieving pressure within said tank (12).

33. An assembly as set forth in claim 32 including an accumulator (70) supported on said tank (12).

34. An assembly as set forth in claim 1 including a liner (74) covering the interior walls of said chamber (25).

35. An assembly as set forth in claim 34 wherein said liner (74) comprises a foam material.

36. An assembly as set forth in claim 34 wherein said liner (74) comprises polyurethane.

37. An assembly as set forth in claim 34 wherein said liner (74) comprises a polyether resin.

38. An assembly as set forth in claim 37 wherein said a polyether resin is further defined as an amine-terminated polyether resin.

39. An assembly as set forth in claim 38 wherein said amine-terminated polyether resin is further defined as having isocyanate groups.

40. An assembly as set forth in claim 1 including a shroud (76) surrounding said motor (30) with an open top for ventilation and deadening the noise of the motor (30).

41. An assembly as set forth in claim 1 wherein said first pump (32) is a positive displacement pump having a low pressure inlet and a high pressure outlet, and including a leakage line (52) in fluid communication with said pump (32) for receiving leakage between said low pressure inlet and said high pressure outlet, said leakage line (52) extending from said pump (32) and through said removable top (26) to a pump leakage port (56) and back through said removable top (26) for drainage into said chamber (25).

42. A hydraulic power assembly for delivering hydraulic fluid to a plurality of hydraulic device, said hydraulic power assembly comprising;

a tank (12) having a bottom (22) and a peripheral side wall (13) extending upwardly from said bottom (22) to a top opening (24) for defining a chamber (25) for containing fluid, a liner (74) comprising foam covering the interior of said chamber (25), a removable top (26) disposed over said top opening (24) to close said chamber (25), fasteners (28) interconnecting said removable top (26) and said side wall(13), a motor (30) disposed on said removable top (26) outside said chamber (25), a first pump (32) depending from said removable top (26) and into said chamber (25) and including a first inlet (34) and a first outlet (35), a second pump (46) depending from said first pump (32) and including an second inlet (48) and an second outlet (50), a drive (60) interconnecting said motor (30) and said first (32) and second (46) pumps in series and in sealing engagement with said removable top (26), a fluid distribution manifold (38) disposed on said removable top (26) out side said chamber (25) and including a plurality of valves (40) for distributing fluid to devices and a return port (44) for receiving return fluid from the devices, fluid lines (36) interconnecting said outlets of said pumps and said manifold (38) for conveying fluid from said outlets to said manifold (38), a return line (62) for returning the return fluid from said manifold (38) to said chamber (25), a first leakage line (52) in fluid communication with said first pump (32) for receiving leakage between said first inlet (34) and said first outlet (35) of said first pump (32), said first leakage line (52) extending through said removable top (26) to a first pump leakage port (56) and back through said removable top (26) for drainage into said chamber (25), a second leakage line (54) in fluid communication with said second pump (46) for receiving leakage between said second inlet (48) and said second outlet (50) of said second pump (46), said second leakage line (54) extending through said removable top (26) to a second pump leakage port (58) and back through said removable top (26) for drainage into said chamber (25), a heat exchanger (78) in fluid communication with said first leakage line (52) and said second leakage line (54) for cooling the fluid, and lift devices (64) on said removable top (26) for lifting said removable top (26) along with said motor (30), said pump, said manifold (38) and said drive (60) from said side wall (13).

43. An assembly as set forth in claim 42 wherein said second pump (46) has a different pumping capacity than said first pump (32).

44. An assembly as set forth in claim 43 including a filter (66) in fluid communication with said manifold (38) for filtering the fluid.

45. An assembly as set forth in claim 44 including tank sight gages (68) disposed on said peripheral side wall (13) and in fluid communication with said chamber (25) for indicating the level of fluid in said tank (12).

46. An assembly as set forth in claim 42 including an accumulator (70) supported on said tank (12) for energy storage and supplementing output of said pumps (32, 46).

* * * * *